US005904022A

United States Patent [19]

Zadok

[11] Patent Number: 5,904,022

[45] Date of Patent: May 18, 1999

[54] AESTHETIC POST AND BEAM CONSTRUCTION HAVING MODULAR PARTS

[76] Inventor: Yigal Zadok, 3121 Rosewood Ct., Davie, Fla. 33328

[21] Appl. No.: 09/010,244

[22] Filed: Jan. 21, 1998

[51] Int. Cl.[6] ..... E04C 3/00; E04C 2/38

[52] U.S. Cl. ..... 52/650.1; 52/650.3; 52/651.01; 52/653.2; 52/656.9; 52/716.1; 52/731.2; 52/731.3; 52/731.4; 52/732.1; 52/732.2; 52/733.3; 52/736.2; 52/737.2

[58] Field of Search ..... 52/650.1, 650.3, 52/651.01, 653.2, 656.9, 716.1, 731.2, 731.3, 731.4, 732.1, 732.2, 733.3, 736.2, 737.2

[56] References Cited

U.S. PATENT DOCUMENTS 4,205,497 6/1980 Schirm ..... 52/731.2 X
4,316,352 2/1982 Harrington et al. ..... 52/732.2 X
5,479,747 1/1996 Wu ..... 52/656.9 X
5,680,737 10/1997 Sheipline ..... 52/656.9 X

*Primary Examiner*—Christopher Kent
*Attorney, Agent, or Firm*—Ronald E. Smith

[57] ABSTRACT

A post and beam construction includes opaque cover members that hide from view fastening members and other utilitarian structural features of the construction for aesthetic purposes. An upper bracket is slideably received in each post at its upper end and a lower bracket is slideably received in each post at its lower end. Each bracket has screw-receiving members formed in it and each post has screw-receiving openings pre-drilled into it in registration with the screw-receiving members to facilitate assembly. The upper bracket slidingly engages a bottom wall of the beam and therefor may be placed at any location along the length of the beam. Self-tapping screws are used to lock the upper bracket and hence the post into a preselected position.

7 Claims, 6 Drawing Sheets

AESTHETIC POST AND BEAM CONSTRUCTION HAVING MODULAR PARTS

BACKGROUND OF THE INVENTION

1. Field of the invention

This invention relates, generally, to post and beam construction. More particularly, it relates to a post and beam construction having modular parts and having means for covering bolts and other structural parts from view to enhance the appearance of the installation.

2. Description of the prior art

Post and beam construction is used in carport construction, covered walkway construction, covered patios, and other covered areas. In a carport environment, first respective ends of plural aluminum roof panels are connected to an existing structure, and their respective second ends are supported by a horizontal beam supported by plural upstanding posts that are spaced apart from the existing structure and from one another by a predetermined distance. In a covered walkway environment, the opposite ends of the roof panels are supported by parallel beams that are in turn supported by upstanding posts. In covered patio environments, or the like, the posts and beams may be arranged in parallel, perpendicular and other angular arrangements with respect to one another.

Post and beam construction is not particularly attractive because the lowermost ends of the upstanding posts are bolted to a concrete support surface, such as a carport floor or a sidewalk. More particularly, outwardly extending flanges are provided at the lowermost ends of said posts, and bolts pass through said flanges to secure said lowermost ends to said concrete surface. Accordingly, anyone walking along a covered walkway or entering a carport or other covered area will see the bolts and the flanges. Similarly, the uppermost ends of the posts are secured to the horizontal beams in the same way, i.e., with flanges and bolts that are visible to viewers of the structure. As a result, post and beam costruction is never used indoors, such as in a bank lobby, for example, because it looks too crude and utilitarian, i.e., it lacks aesthetic appeal.

Moreover, the known method of installing posts and beams generally requires skilled laborers to perform the task because the location of various bolt-receiving holes in the beams and in the concrete must be carefully determined by measurement prior to the drilling of said holes.

There is a need, then, for a new post and beam construction technique that would provide attractive post and beam installations so that such construction could be used in environments where appearances are important.

There is also a need for a modular post and beam construction so that the skill level required to install the parts could be lowered. Specifically, there is a need for parts having pre-drilled holes so that a skilled worker is not required to take careful measurements and drill numerous holes as a part of the installation process.

However, in view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious invention. The present invention is a post and beam construction that includes an elongate hollow beam having a top wall and a bottom wall, and at least one upstanding post for supporting the beam, the post having opposing side walls. An upper bracket is slideably disposed within the hollow post at an uppermost end thereof, and a sliding engagement means for slideably interconnecting the upper bracket and the bottom wall of the beam is provided so that the bracket and hence the post is positionable at any selected location along the extent of the beam. The upper bracket has integral screw-receiving means formed therein and the upper end of the post has pre-formed screw-receiving openings formed therein that are in registration with the screw-receiving means when the upper bracket is received within the post to facilitate connection of the upper bracket to the post. A lower bracket is disposed within the hollow post at a lowermost end thereof; the lower bracket also has integral screw-receiving means formed therein and the lower end of the post also has pre-formed screw-receiving openings formed therein that are in registration with the lower bracket screw-receiving means when the lower bracket is received within the post to facilitate connection of the lower bracket to the post. Means are further provided for securing the lower bracket in fixed relation to a support surface, and opaque cover means are provided for covering at least one end of the beam, at least one sidewall of the post, and a bottom wall of the beam so that at least one end of the beam is covered, so that at least one sidewall of the post is covered, thereby concealing the screws that secure the upper bracket and the lower bracket to the post, and so that the bottom wall of the beam is covered.

It is a primary object of this invention to provide a post and beam construction having aesthetic appeal to enable such construction to be used in environments where exposure to view of bolts, flanges, and the like is unwanted.

Another object is to provide a modular post and beam construction including parts having pre-drilled bolt-receiving holes to lower the skill level required for installation and to facilitate the installation as well.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
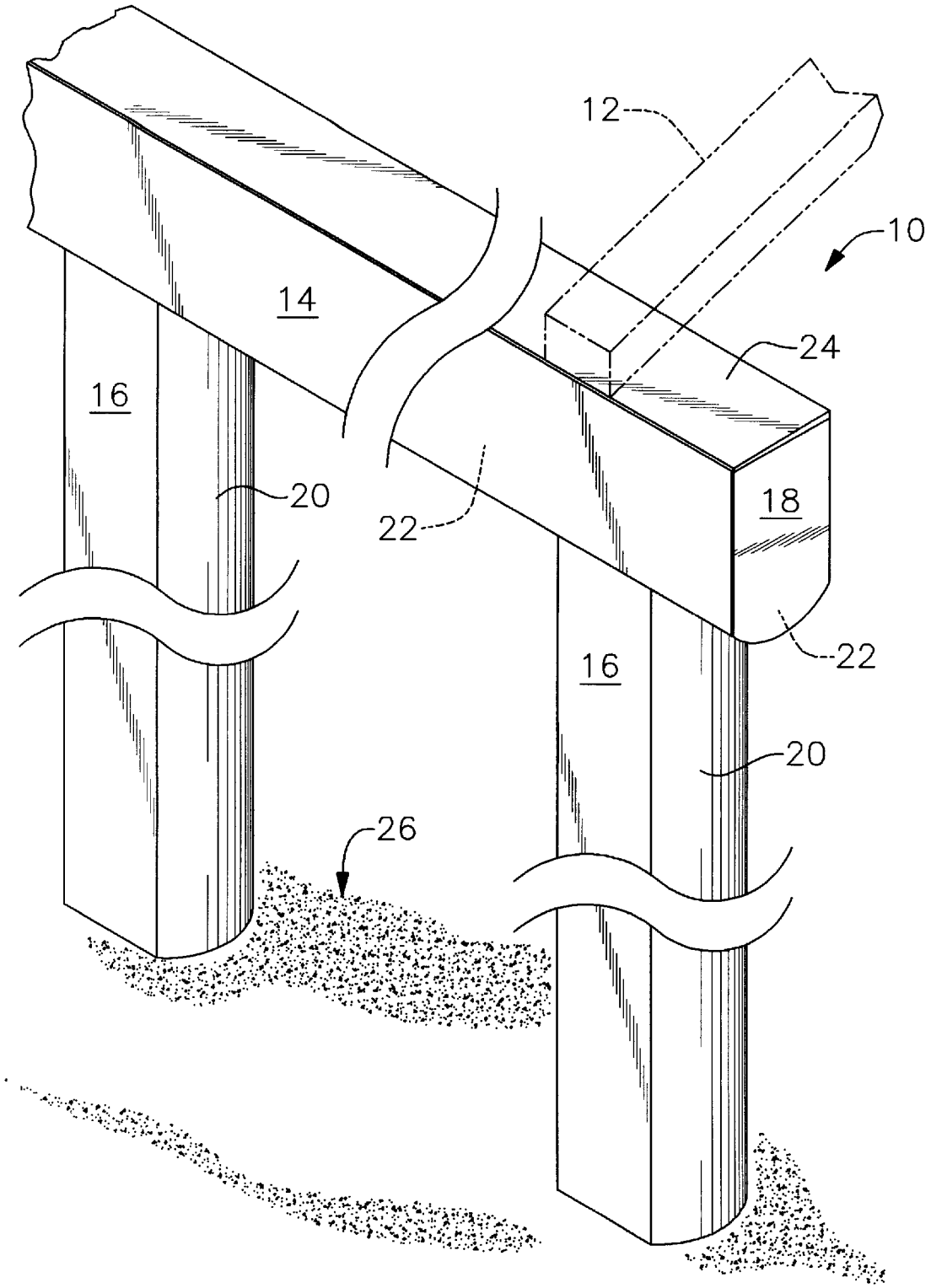
FIG. 1 is a perspective view depicting a post and beam construction in a carport or other covered environment.

Referring now to FIG. 1, it will there be seen that an exemplary embodiment of the invention is denoted as a whole by the reference numeral 10.

Environment 10 is that of a carport or similar structure; it could be a covered patio or other covered area. An aluminum roof pan 12, depicted in phantom lines, has a second or outward end supported by elongate, horizontally disposed beam 14. The first or inward end of pan 12 is connected to a header, not shown, which in turn is connected to an existing structure, not shown. No such header is needed if the covered area is not attached to an existing structure.

Beam 14 is supported along its length by a plurality of longitudinally spaced apart, upstanding posts, collectively denoted 16. Flat end cover plate 18 covers the end of beam 14, curved post-covering cover plates 20 cover opposing sidewalls of posts 16, and curved beam-covering cover plates 22, having the same structure as post-covering cover plates 20, cover bottom wall 15 of beam 14. Top wall 17 of beam 14 is covered by a slope adaptor member denoted 24, and posts 16 are anchored in a concrete support surface 26 at their respective lowermost ends.

It is immediately apparent that no flanges, bolts, drill holes, or the like are visible upon inspection of post and beam construction 10. Thus, the structure may be used in any location where good looks are important, including interior locations such as hotel or bank lobbies, corporate headquarters, and commercial buildings of all types. However, due to the low cost and ease of constructability which arises from the modular structure of the novel apparatus, the novel structure retains its utility in connection with conventional applications such as carports, covered walkways, and the like.

Figure 2:
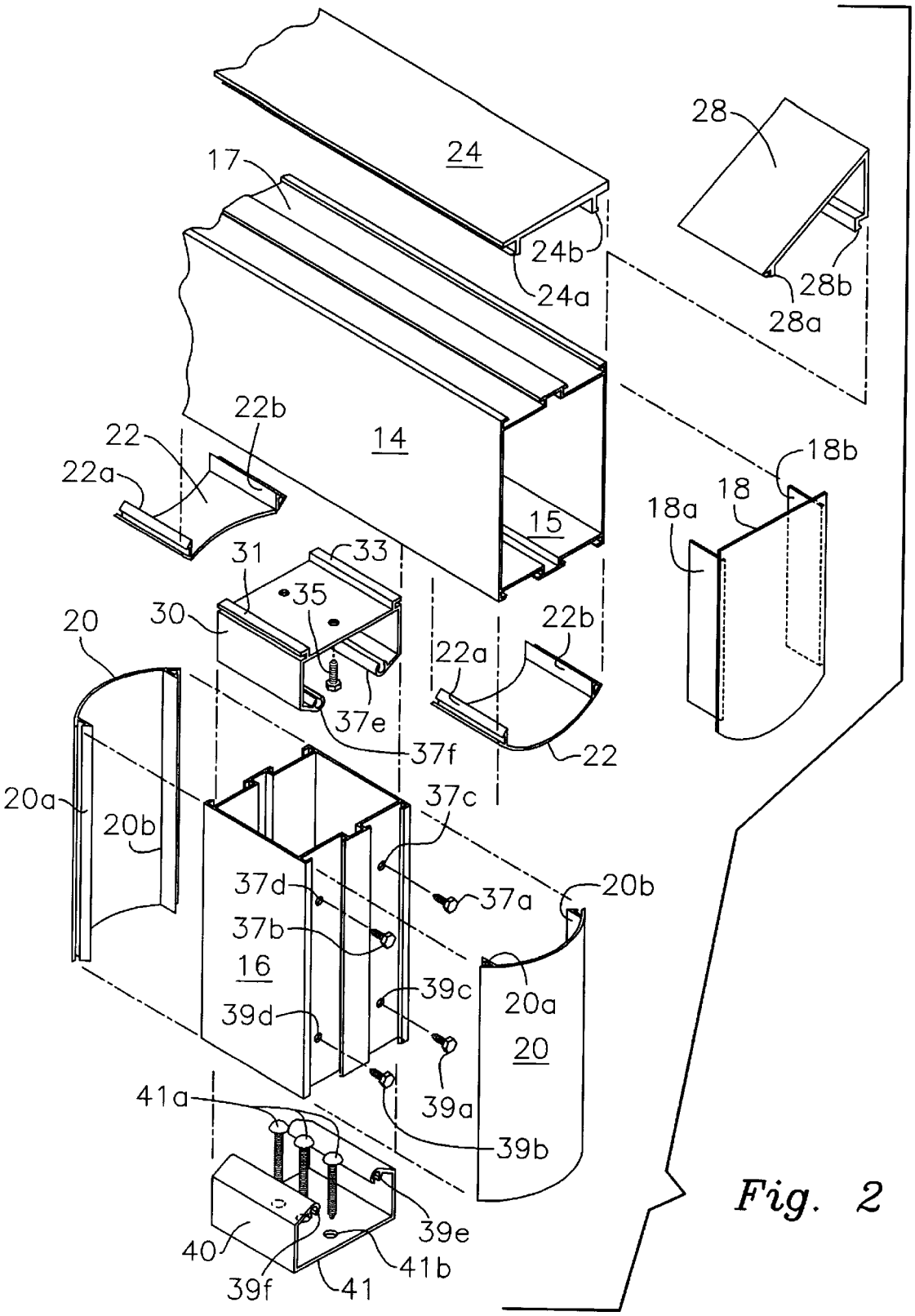
FIG. 2 is an exploded perspective view depicting the pertinent parts of the novel assembly, with some of the parts be depicted in cut-away to reduce the size of the Figure.

FIG. 2 depicts beam 14, post 16, end plate 18, post sidewall cover members 20, beam bottom wall cover members 22, and slope adaptor 24 in exploded view. Said FIG. further depicts a second slope adaptor 28 that is used when first slope adaptor 24 is not used. As perhaps best understood in connection with FIG. 1, first slope adaptor 24 is connected to top wall 17 of beam 14 when the slope of the roof collectively defined by roof pans such as roof pan 12 is nominal. It should be clear, then, that second slope adaptor 28 is used when the slope of the roof formed by plural pans 12 is to be quite steep. Clearly, there are as many slope adaptors 24 or 28 as there are degrees of pitch for a roof.

Figure 3:
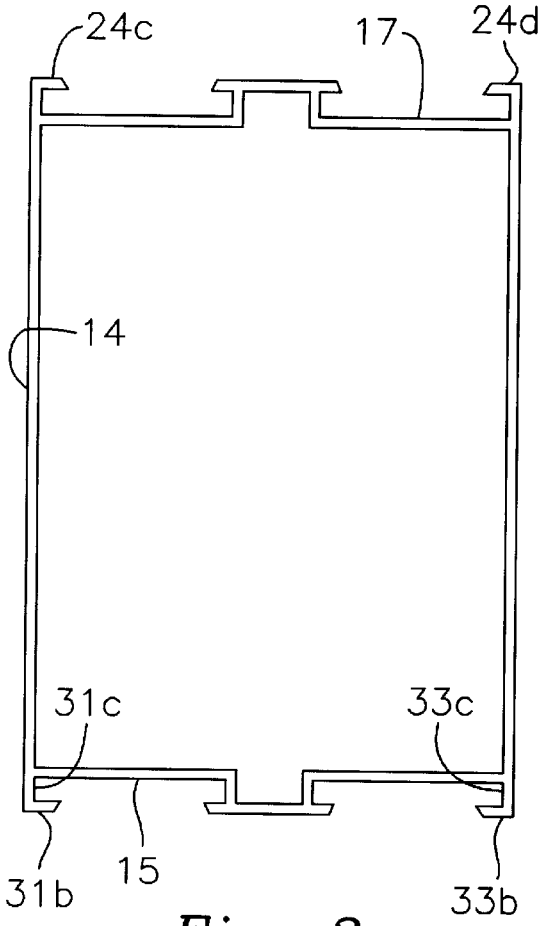
FIG. 3 is an end view of the novel beam.
Figure 6:
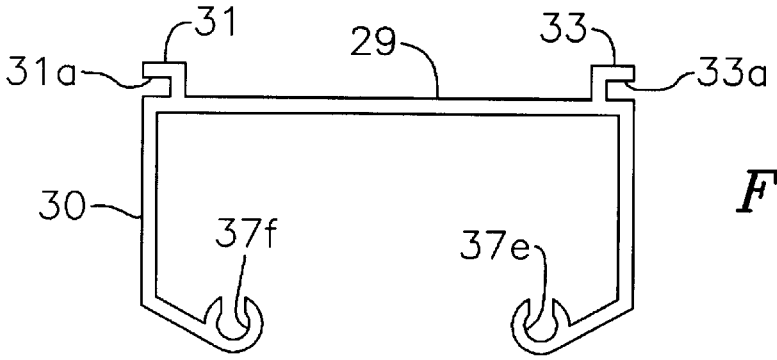
FIG. 6 is an end view of a modular bracket that interconnects the upper end of a post to a beam.

FIG. 2 further depicts a modular bracket 30 that slideably fits within the uppermost end of a post 16 and which slidingly engages bottom wall 17 of beam 14; it is usually referred to hereinafter as the upper bracket. As perhaps best understood in connection with FIGS. 3 and 6, depicting beam 14 and upper bracket 30, respectively, bracket 30 includes a pair of longitudinally extending, outwardly-opening slot-defining members or lips 31, 33 that are disposed in closely spaced relation to top wall 29 and which respectively define longitudinally-extending, outwardly-opening slots 31*a*, 33*a*. As indicated in FIG. 3, beam 14 having bottom wall 15 includes a pair of longitudinally and inwardly-extending lips 31*b*, 33*b* that are disposed in closely spaced relation to said bottom wall 15. To connect a post 16 to a beam 14 at any preselected location along the extent of said beam, bracket 30 is placed in alignment with a beam 14 at a preselected end thereof so that slots 31*a*, 33*a* of bracket 30 are aligned with lips 31*b*, 33*b*. Bracket 30 is then slid onto beam 14 with lips 31*b*, 33*b* of beam 14 being slideably received within slots 31*a*, 33*a* of bracket 30, respectively. Significantly, due to the sliding connection between upper bracket 30 and beam 14, said upper bracket 30 may be easily placed anywhere along the extent of beam 14. After bracket 30 is properly positioned, it is secured to bottom wall 15 of beam 14 by a pair of self-tapping screws, only one of which, denoted 35, is visible in FIG. 2.

It is then a simple matter to slide the uppermost end of a hollow post 16 onto upper bracket 30 as indicated by the assembly lines appearing in FIG. 2 between said two parts 16 and 30. Screws 37*a*, 37*b* (FIG. 2) are then introduced through openings 37*c*, 37*d* formed in a side wall of post 16; said screws screw-threadedly engage transversely spaced apart, longitudinally-extending screw-receiving channels 37*e*, 37*f*, respectively, that form an integral part of bracket 30, said channels being depicted in both FIG. 2 and FIG. 6. Holes 37*c*, 37*d* are pre-drilled so proper connection between the uppermost end of a post 16 and a beam 14 is assured.

Figure 8:
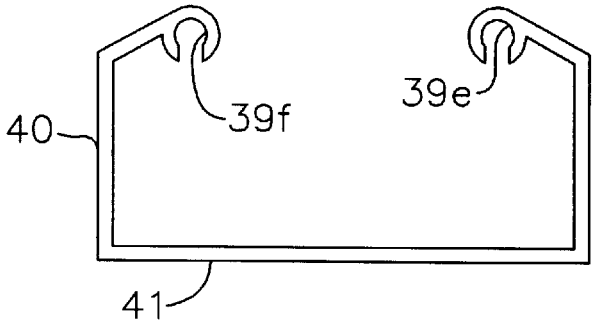
FIG. 8 is an end view of a modular bracket that interconnects the lower end of a post to a concrete support surface.

A similar bracket 40, depicted in FIGS. 2 and 8, is slidingly received within the lowermost end of its associated post 16, as indicated by the assembly lines between said parts at the bottom of FIG. 2. Lower bracket 40 also includes a pair of transversely spaced apart, longitudinally-extending screw-receiving channels 39*e*, 39*f* respectively screw-threadedly receive screws 39*a*, 39*b* that extend through pre-drilled holes 39*c*, 39*d*, respectively, formed in each sidewall of post 16. Prior to insertion of lower bracket 40 into the lower end of post 16, however, a plurality of cement screws, called tapcons and collectively denoted 41*a*, are inserted into concrete support surface 26 (FIG. 1) through holes 41*b*, only one of which is visible in FIG. 2, that are pre-drilled in bottom wall 41 of bracket 40.

Figure 9:
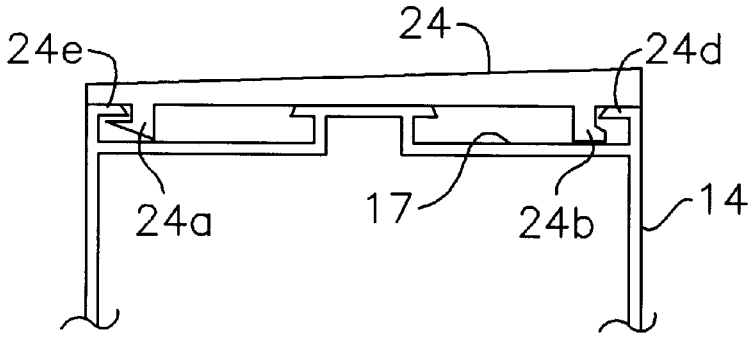
FIG. 9 is an end view of the upper wall of the beam depicted FIG. 3 when covered by a first slope adaptor.
Figure 10:
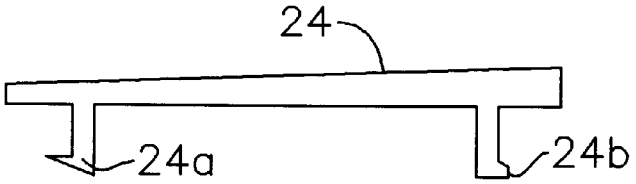
FIG. 10 is an end view of the first slope adaptor depicted FIG. 9.
Figure 11:
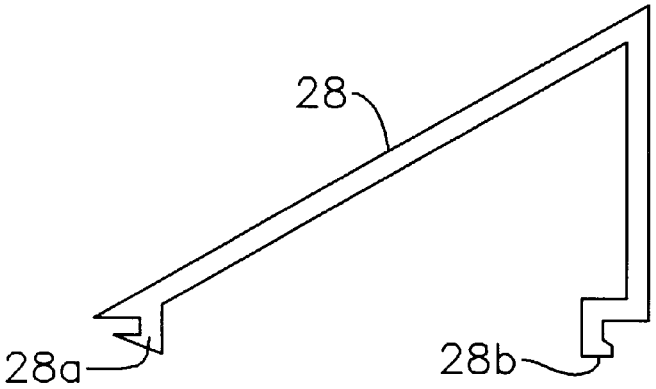
FIG. 11 is an end view of a second slope adaptor that is also connectable to the upper wall of the beam depicted FIG. 3 when the first slope adaptor is not used.

It is then a simple matter to finish the installation by snapping slope adaptor 24, or slope adaptor 28, or a slope adaptor having a different slope, into overlying relation to top wall 17 of beam 14. As depicted in FIG. 9, dogs 24*a*, 24*b* respectively engage longitudinally-extending slots defined by longitudinally-extending lips 24*c*, 24*d* that are disposed in closely spaced relation to top wall 17 of beam 14. See also FIG. 10. FIG. 11 depicts dogs 28*a*, 28*b* that are engaged to lips 24*c*, 24*d*, respectively, in the same way when slope adaptor 28 is employed in lieu of slope adaptor 24.

Figure 4:
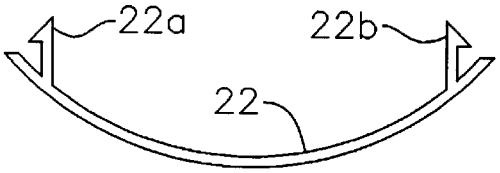
FIG. 4 is an end view of a cover that is attached to the bottom wall of the beam depicted in FIG. 3 so that said bottom wall is hidden from view when viewed from below said beam.
Figure 12:
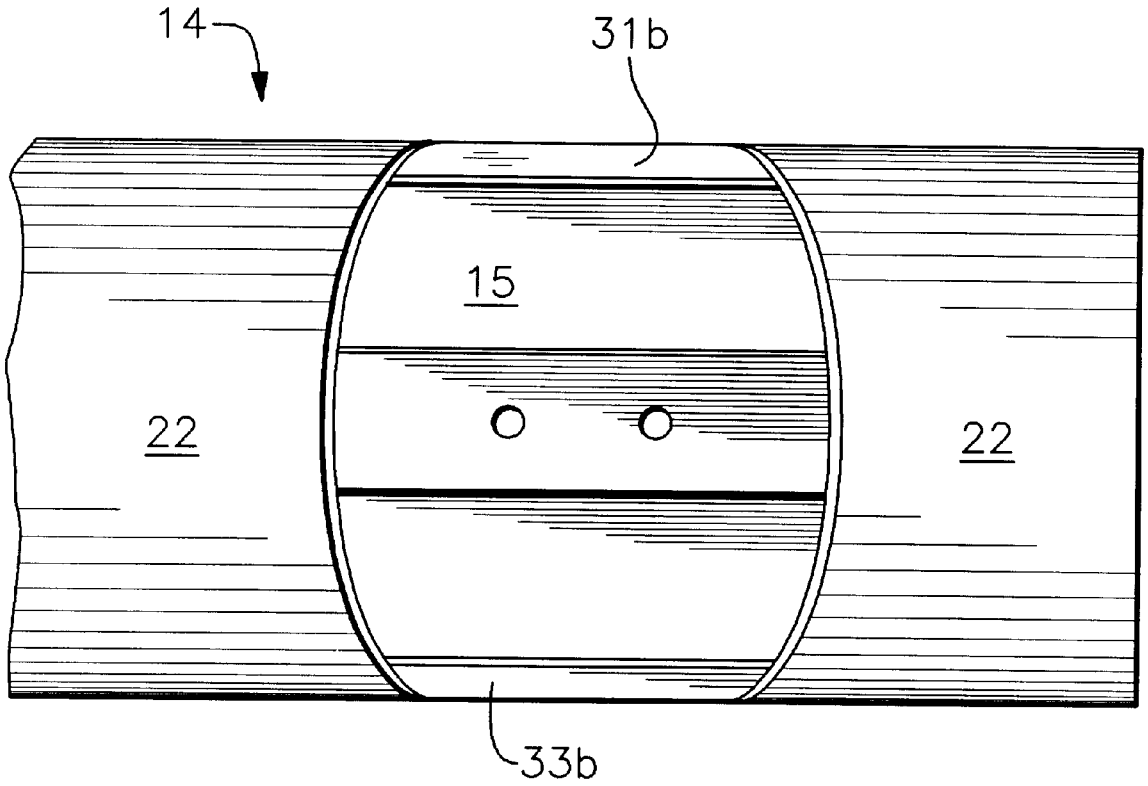
FIG. 12 is a bottom plan view of a beam when bottom cover members such as depicted in FIG. 4 are in place but with the upstanding post removed to show the pre-drilled holes formed in said beam.

Cover members 18, 20, and 22 are then snapped into position as indicated in FIG. 2 and the installation of the covered walkway, carport, or the like is complete. As indicated in FIG. 4, bottom cover plate 22 has dogs 22*a*, 22*b* that, as best understood by considering FIG. 3 in conjunction with FIG. 4, are snap fit into slots 31*c*, 33*c* defined by longitudinally-extending lips 31*b*, 33*b*, respectively. FIG. 12 depicts cover members 22, 22 in place, but with post 16 removed for clarity, it being understood that said cover members are not installed until after post 16 is in place and it being further understood that the holes appearing in FIG. 12 are not pre-drilled into bottom wall 15 of beam 14 but are formed only when upper bracket 30 is attached to said beam with self-tapping screws 35 as mentioned earlier.

Figure 5:
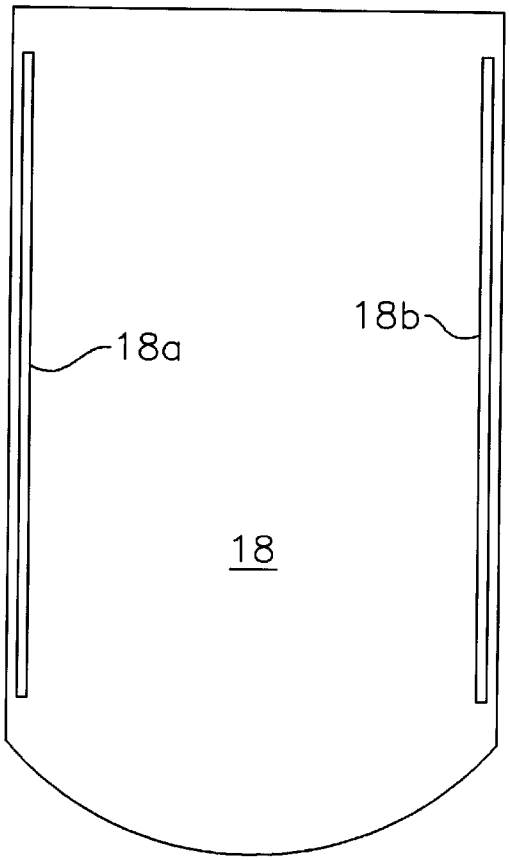
FIG. 5 is an end view of a cover that is attached to opposite ends of the novel beam depicted in FIG. 3 so that the configuration of the beam is hidden from view when vied from the end thereof.

As indicated in FIG. 5, end cover plate 18 has transversely spaced apart, upstanding flat arms 18*a*, 18*b* that are disposed normal to the plane of flat plate 18, said arms being press fit into each open end of beam 14.

Figure 7:
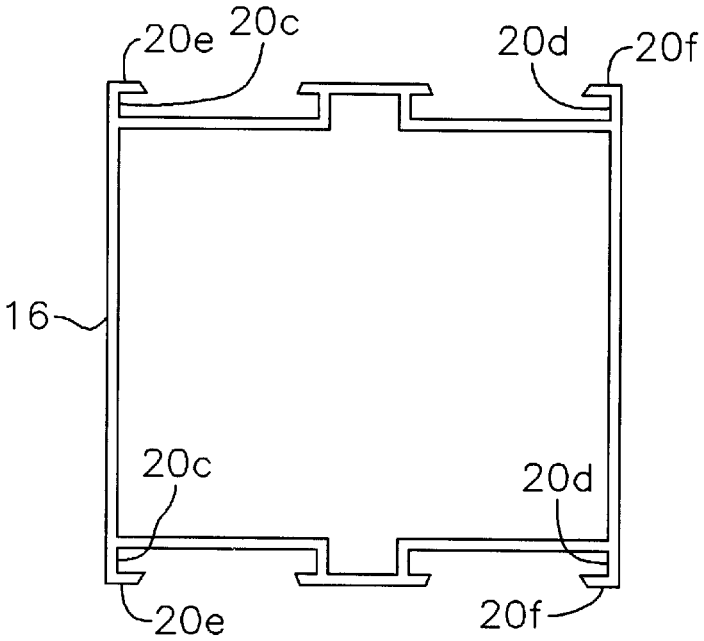
FIG. 7 is a plan view of an upstanding beam.

As best understood by comparing FIGS. 2 and 7, post sidewall cover members 20 are snapped into engagement with posts 16 by inserting dogs 20*a*, 20*b* that form an integral part of each cover 20 into longitudinally-extending slots 20*c*, 20*d* defined by lips 20*e*, 20*f*, respectively.

No special tools are needed and no measurements need be taken to complete the installation. The aesthetically-pleasing post and beam construction having no visible bolts or flanges is therefore easily constructed by unskilled labor. Advantagously, the various parts such as beam 14, post 16, and brackets 30, 40 are commercially available extruded parts, being used with other parts in unrelated ways and in unrelated structures.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A post and beam construction, comprising:

an elongate hollow beam having a top wall and a bottom wall;

an upstanding post for supporting said beam, said post having opposing sidewalls;

an upper bracket slideably disposed within said hollow post at an uppermost end of said hollow post;

sliding engagement means for slideably interconnecting said upper bracket and said post so that said bracket and hence said post is positionable at any selected location along the extent of said beam;

said upper bracket having integral screw-receiving means formed therein and said post having pre-formed screw-receiving openings formed therein that are in registration with said screw-receiving means when said upper bracket is received within said post to facilitate connection of said upper bracket to said post;

a lower bracket disposed within said hollow post at a lowermost end of said post;

said lower bracket having integral screw-receiving means formed therein and said post having pre-formed screw-receiving openings formed therein that are in registration with said lower bracket screw-receiving means when said lower bracket is received within said post to facilitate connection of said lower bracket to said post;

means for securing said lower bracket in fixed relation to a support surface; and cover means for covering at least one end of said beam, at least one sidewall of said post, and said bottom wall of said beam;

whereby screws securing said upper bracket and said lower bracket to said post are covered and therefor hidden from view;

whereby at least one end of said beam is covered;

whereby at least one sidewall of said post is covered; and whereby said bottom wall of said beam is covered.

2. The construction of claim 1, wherein said sliding engagement means comprises a pair of longitudinally extending, transversely spaced apart lips formed integrally with said beam in closely spaced apart relation to said bottom wall and a pair of longitudinally extending, transversely spaced apart lips formed in said upper bracket in closely spaced apart relation to a top wall of said upper bracket so that said lips of said upper bracket slidingly engage said lips of said beam.

3. The construction of claim 1, wherein said cover means for covering at least one end of said beam includes a flat cover plate having a pair of transversely spaced apart, flat, upright arms disposed normal to said flat cover plate in parallel relation to one another, said arms being press fit into at least one end of said beam to position said flat cover plate in overlying relation to said at least one end.

4. The construction of claim 1, wherein said cover means for covering at least one sidewall of said post includes a pair of transversely spaced apart, longitudinally-extending lips formed integrally with said post in closely spaced apart relation to said at least one sidewall of said post, and a cover member having a pair of transversely spaced apart, longitudinally-extending dogs integrally formed therewith for engaging said lips.

5. The construction of claim 1, wherein said cover means for covering a bottom wall of said beam includes a pair of transversely spaced apart, longitudinally-extending lips formed on said beam in closely spaced apart relation to said bottom wall of said beam, and a cover member having a pair of transversely spaced apart, longitudinally-extending dogs integrally formed therewith for engaging said lips.

6. The construction of claim 1, further comprising a slope adaptor and means for attaching said slope adaptor to said top wall of said beam.

7. The construction of claim 6, wherein said means for attaching said slope adaptor to said top wall of said beam includes a pair of transversely spaced apart, longitudinally-extending lips formed in said beam in closely spaced apart relation to said top wall of said beam, said slope adaptor having a pair of transversely spaced apart, longitudinally-extending dogs integrally formed therewith for engaging said lips.

* * * * *